United States Patent [19]

Dickerson

[11] Patent Number: 4,520,098

[45] Date of Patent: May 28, 1985

[54] PHOTOGRAPHIC ELEMENT EXHIBITING REDUCED SENSITIZING DYE STAIN

[75] Inventor: Robert E. Dickerson, Rochester, N.Y.

[73] Assignee: Eastman Kodak Company, Rochester, N.Y.

[21] Appl. No.: 615,631

[22] Filed: May 31, 1984

[51] Int. Cl.[3] ..... G03C 1/00; G03C 1/02

[52] U.S. Cl. ..... 430/495; 430/496; 430/507; 430/567; 430/570; 430/966

[58] Field of Search ..... 430/567, 570, 569, 507, 430/496, 495, 966

[56] References Cited

U.S. PATENT DOCUMENTS

| | | | |
|---|---|---|---|
| 2,327,764 | 8/1943 | Carroll | 430/507 |
| 3,745,015 | 7/1973 | Van Pee et al. | 430/567 |
| 4,094,684 | 6/1978 | Maskasky | 430/567 |
| 4,184,878 | 1/1980 | Maternaghan | 430/567 |
| 4,386,156 | 5/1983 | Mignot | 430/567 |
| 4,399,215 | 8/1983 | Wey | 430/567 |
| 4,400,463 | 8/1983 | Maskasky | 430/434 |
| 4,414,304 | 11/1983 | Dickerson | 430/353 |
| 4,414,306 | 11/1983 | Wey et al. | 430/434 |
| 4,425,425 | 1/1984 | Abbott et al. | 430/502 |
| 4,425,426 | 1/1984 | Abbott et al. | 430/502 |
| 4,435,501 | 3/1984 | Maskasky | 430/434 |
| 4,439,520 | 3/1984 | Kofron et al. | 430/434 |

FOREIGN PATENT DOCUMENTS

| | | | |
|---|---|---|---|
| 84637 | 8/1983 | European Pat. Off. | 430/495 |
| 52-130639 | 11/1977 | Japan . | |
| 1413826 | 11/1975 | United Kingdom . | |
| 2110831A | 11/1982 | United Kingdom . | |
| 2132378A | 12/1983 | United Kingdom . | |

*Primary Examiner*—Mary F. Downey
*Attorney, Agent, or Firm*—Carl O. Thomas

[57] ABSTRACT

A spectrally sensitized silver halide photographic element capable of producing a stable, viewable silver image on development and fixing out is disclosed. The latent image forming silver halide grains in the image recording emulsion layer or layers of the photographic element are silver bromide, chloride, or chlorobromide grains. At least one of the image recording emulsion layers contains spectrally sensitized tabular grains. Located in proximity to the spectrally sensitized tabular grains are relatively fine high iodide silver halide grains capable of being dissolved during fixing out.

16 Claims, No Drawings

PHOTOGRAPHIC ELEMENT EXHIBITING REDUCED SENSITIZING DYE STAIN

FIELD OF THE INVENTION

This invention relates to silver halide photographic elements capable of producing viewable silver images. The invention relates more specifically to an improvement in photographic elements containing spectrally sensitized tabular grain silver halide emulsions.

BACKGROUND OF THE INVENTION

Stable, viewable black and white photographs can be produced by imagewise exposing a photographic element containing one or more radiation sensitive silver halide emulsion layers capable of producing a developable latent image. To extend the response of the silver halide into the green and/or red regions of the visible spectrum and thereby better approximate the image seen by the human eye it is common practice to adsorb a spectral sensitizing dye to the surfaces of the silver halide grains in the emulsion layers. Following imagewise exposure a viewable image can be produced by development in an aqueous alkaline processing solution. The imagewise conversion of silver halide to metallic silver provides the viewable image. To avoid an eventual increase in density attributable to residual silver halide it is common practice to fix out (dissolve and remove by washing) the residual, undeveloped silver halide grains. This leaves a stable, viewable silver image in the photographic element.

In silver halide photography a choice of three halides, chloride, bromide, and iodide, and combinations thereof are available. Silver iodide is known to be the most difficult silver halide to employ for producing a latent image and developing and is seldom used alone in emulsions intended to be processed by development in aqueous alkaline solutions followed by fixing out. When present in a photographic element silver iodide is often relegated to performing functions which do not require the formation of a developable latent image in silver iodide grains. The following are illustrative of known uses of silver iodide grains and soluble iodide salts:

P-1 Carroll U.S. Pat. No. 2,327,764 discloses the use of silver iodide as an ultraviolet filter for a color photographic element;

P-2 Van Pee et al. U.S. Pat. No. 3,745,015 discloses the incorporation of a silver iodide sol in a direct print radiation sensitive silver halide emulsion;

P-3 Maskasky U.S. Pat. No. 4,094,684 discloses radiation sensitive silver iodide grains onto which have been epitaxially grown silver chloride;

P-4 Maternaghan U.S. Pat. No. 4,184,878 discloses the use of high iodide silver halide grains as seed grains in preparing tabular grain silver bromoiodide emulsions;

P-5 U.K. Specification No. 1,413,826 discloses the use of 0.01 to 1.0 mole percent soluble iodide to assist in the spectral sensitization of silver bromoiodide;

P-6 Maskasky U.K. Specification No. 2,132,373 discloses gamma phase tabular grain silver iodide emulsions; and P-7 Japanese Kokai Pat. No. Sho 52[1977]-130639 discloses the use of potassium iodide in a fixing solution to increase fixing speed.

The highest speed silver halide emulsions are silver bromoiodide emulsions, which are most frequently employed for camera speed imaging. These emulsions contain bromide as the predominant halide. Silver iodide can be present up to its solubility limit in silver bromide, about 40 mole percent, but is seldom employed in concentrations above 20 mole percent and is usually employed in concentrations below 10 mole percent.

For a number of photographic applications processing speed and convenience are of paramount importance. Silver chloride, silver bromide, and silver chlorobromide emulsions are outstandingly suited for these applications, since they can be more rapidly processed than silver iodide or silver bromoiodide emulsions. Further, acceptable processing of these emulsions can be obtained with greater variances in the time and temperature of processing.

Interest in silver halide photography has recently focused on tabular grain emulsions, particularly intermediate and high aspect ratio tabular grain emulsions. It has been shown that the latter emulsions can produce increased image sharpness. When efficiently chemically and spectrally sensitized, these emulsions exhibit outstanding speed-granularity relationships. Higher silver covering power has been observed in fully forehardened photographic elements. In radiographic elements with emulsion coatings on each of the two opposite faces of the support marked reductions in crossover have been observed using high aspect ratio tabular grain emulsions, and improvements in speed at comparable crossover levels have been demonstrated using thin, intermediate aspect ratio tabular grain emulsions.

Photographic elements containing tabular grain silver bromide, silver chloride, and silver chlorobromide emulsions as well as their sensitization, use, and advantages are illustrated by the following:

P-8 Mignot U.S. Pat. No. 4,386,156 discloses a tabular grain silver bromide emulsion wherein tabular silver bromide grains bounded by {100} major crystal faces and having an average aspect ratio of at least 8.5:1, account for at least 50 percent of the total projected area of the silver bromide grains present in the emulsion;

P-9 Wey U.S. Pat. No. 4,399,215 discloses a tabular grain silver chloride emulsion wherein the tabular grains have an average aspect ratio greater than 8:1;

P-10 Maskasky U.S. Pat. No. 4,400,463 discloses a tabular grain emulsion the grains of which are at least 50 mole percent chloride and have one or more edges of a particular crystallographic orientation;

P-11 Dickerson U.S. Pat. No. 4,414,304 discloses fully forehardened photographic elements capable of producing a stable, viewable silver image of increased covering power by reason of containing a high aspect ratio tabular grain silver halide emulsion;

P-12 Wey et al. U.S. Pat. No. 4,414,306 discloses tabular grain silver halide emulsions wherein the halide is a combination of chloride and bromide;

P-13 and P-14 Abbott et al. U.S. Pat. Nos. 4,425,425 and 4,425,426 disclose radiographic elements containing silver halide emulsion layers on opposite major faces of a support. High and intermediate aspect ratio tabular grain silver bromide emulsions are specifically disclosed;

P-15 Maskasky U.S. Pat. No. 4,435,501 discloses the selective site epitaxial sensitization of high aspect ratio tabular grain silver halide emulsions;

P-16 Kofron et al. U.S. Pat. No. 4,439,520 discloses efficiently chemically and spectrally sensitized high aspect ratio tabular grain silver halide emulsions; and P-17 Daubendiek et al. U.K. Specification No. 2,110,831A discloses direct positive silver halide emulsions containing internal latent image forming high aspect ratio tabular grain emulsions.

A disadvantage that has been discovered with the use of spectrally sensitized tabular grain silver bromide, silver chloride, and silver chlorobromide emulsions in producing stable, viewable silver images is dye stain. In contrast to spectrally sensitized silver halide emulsions of similar halide content which are not tabular grain emulsions, sufficient residual spectral sensitizing dye remains in the photographic element at the conclusion of processing to increase the density in the low and intermediate density regions of the image bearing photographic element. Dye stain can be undesirable in altering image tone. Variations in image tone are particularly undesirable in radiography, since this can complicate proper interpretation of X-ray images. Further, residual dye stain is objectionable in that it does not affect all wavelengths equally. Rather, it is particularly large at wavelengths at or near the absorption peak of the dye. Residual dye stain is highly objectionable where it is desired to scan the photographic image with a laser of a wavelength approximating the absorption peak of the spectral sensitizing dye.

SUMMARY OF THE INVENTION

In one aspect this invention is directed to a photographic element capable of producing a stable, viewable silver image on development in an aqueous alkaline processing solution and fixing out comprising a support and one or more image recording silver halide emulsion layers each comprised of a dispersing medium and latent image forming silver halide grains, the halide consisting essentially of chloride, bromide, or mixtures thereof, at least one of the image recording silver halide emulsion layers being comprised of spectral sensitizing dye adsorbed to the surface of tabular latent image forming silver halide grains having a thickness of less than 0.5 μm and an average aspect ratio of at least 5:1 accounting for at least 35 percent of the total projected area of said latent image forming silver halide grains present in said silver halide emulsion layer, the improvement comprising high iodide silver halide grains of less than 0.25 μm in mean diameter located in proximity to said tabular silver halide grains and limited to a concentration capable of being dissolved on fixing out.

It has been discovered that the introduction of the relatively fine high iodide silver halide grains dramatically reduces dye stain in the photographic elements containing tabular grain silver chloride, silver bromide, and silver chlorobromide emulsions. Thus, the advantages of intermediate and high aspect ratio silver halide emulsions and the processing advantages of silver chloride, silver bromide, and silver chlorobromide emulsions are both realized while reducing dye stain attributable to the presence of spectral sensitizing dye.

DESCRIPTION OF PREFERRED EMBODIMENTS

This invention relates to an improvement in photographic elements intended to produce stable, viewable silver images as a result of imagewise exposure, development in an aqueous alkaline processing solution, and fixing out to remove residual silver halide. The photographic elements are comprised of a support and one or more image recording silver halide emulsion layers containing tabular latent image forming silver halide grains. In addition, relatively fine high iodide silver halide grains are present in at least one image recording tabular grain emulsion layer or in proximity thereto.

The high iodide silver halide grains can consist essentially of silver iodide or can contain other halides—i.e., bromide or chloride—in minor amounts. It is generally preferred to limit the other halides to those concentrations capable of existing in $\beta$ or $\gamma$ phase silver iodide without phase separation. Typically the high iodide silver halide grains contain at least 90 mole percent iodide, based on silver.

Relatively fine high iodide silver halide grains are employed. The grains are less than 0.25 μm in mean diameter, preferably less than 0.10 μm in mean diameter. The above maximum mean diameters are based on the assumption that relatively regular grains will be employed, such as regular $\gamma$ phase (cubic) or regular $\beta$ phase (hexagonal pyramidal) grains. In substituting high iodide silver halide grains of irregular configuration, such as tabular grains, equivalent results can be obtained with larger mean diameter grains. The minimum mean diameters of the high iodide silver halide grains are limited only by synthetic convenience. Typically grains of at least about 0.01 μm in mean diameter are employed.

The high iodide silver halide grains are preferably relatively monodispersed. It is preferred to employ high iodide silver halide grains having a coefficient of variation of less than 20. As employed herein the coefficient of variation is defined as 100 times the standard deviation of the grain diameter divided by the average grain diameter.

The concentration of the high iodide silver halide grains is limited to a level that can be removed during fixing out. This is inversely related to both mean grain diameter and the coefficient of variation of the grains. In general the silver iodide provided by the high iodide silver halide grains is limited to less than 5 mole percent of the total silver halide present in the photographic element, preferably less than 3 mole percent, and optimally less than 1 mole percent. Very small concentrations of high iodide silver halide grains are effective. Silver iodide concentrations of at least 0.1 mole percent are effective to produce observable reductions in dye stain.

High iodide silver halide grains can be prepared in the form of emulsions according to procedures generally known in the art. Such emulsions and their preparation are disclosed by Maternaghan U.S. Pat. No. 4,184,878 and Daubendiek et al. U.S. Pat. No. 4,414,310.

Once prepared the high iodide silver halide grains can be placed in proximity with the latent image forming spectrally sensitized tabular grains of the photographic elements of this invention by blending the emulsions containing the respective grain populations. Blending can be undertaken at any stage of element preparation following precipitation of the emulsions, but is preferably delayed until just before coating to minimize the risk of halide migration between the separate grain populations. Preferably, the high iodide silver halide grains are located in a separate layer of the photographic element located to permit ionic transport between the image recording emulsion layer or layers containing the spectrally sensitized tabular grains and the high iodide silver halide grains during processing. For example, a high iodide silver halide emulsion, as precipitated or supplemented by additional vehicle and addenda augmenting the dispersing medium, can be coated between the spectrally sensitized tabular grain emulsion layer and the support or can form an overcoat positioned to receive processing solutions before the spectrally sensitized tabular grain emulsion layer. Where multiple image recording layers are present, interlayer location for the high iodide silver halide grains is advantageous. It is not essential that the high iodide silver halide grains be in a layer contiguous to the image recording layer containing spectrally sensitized tabular grains, although this is usually preferred.

Each of the image recording emulsion layers is comprised of a dispersing medium and radiation sensitive, latent image forming silver halide grains. The latent image forming silver halide grains of at least one of the image recording emulsion layers are spectrally sensitized by having a spectral sensitizing dye adsorbed to the grain surfaces, and the spectrally sensitized grains together with the dispersing medium form a tabular grain emulsion. The latent image forming silver halide grains present in the photographic element are in each instance substantially free of iodide, although small amounts of iodide can be adsorbed to the grain surfaces to promote aggregation and adsorption of the spectral sensitizing dye. The silver halide present in the latent image forming silver halide grains consists essentially of silver chloride, silver bromide, or silver chlorobromide.

Tabular grains are herein defined as those having two substantially parallel crystal faces, each of which is substantially larger than any other single crystal face of the grain. The term "tabular grain emulsion" is herein defined as requiring that the tabular silver halide grains having a thickness of less than 0.5 μm have an average aspect ratio of at least 5:1 and account for at least 35 percent of the total projected area of the silver halide grains present in the emulsion.

Preferred tabular grain emulsions are intermediate and high aspect ratio tabular grain emulsions. As applied to tabular grain emulsions the term "high aspect ratio" is hereined defined as requiring that the silver halide grains having a thickness of less than 0.3 μm and a diameter of at least 0.6 μm have an average aspect ratio of greater than 8:1 and account for at least 50 percent of the total projected area of the silver halide grains present in the emulsion. The term is thus defined in conformity with the usage of this term in the patents relating to tabular grain emulsions cited above.

The term "intermediate aspect ratio" as applied to tabular grain emulsions is defined as requiring that the tabular silver halide grains having a thickness of less than 0.3 μm and an average aspect ratio in the range of from 5:1 to 8:1 account for at least 50 percent of the total projected area of the silver halide grains present in the emulsion. The term "thin, intermediate aspect ratio" is similarly defined, except that the reference thickness of 0.3 μm noted above is replaced by a reference thickness of 0.2 μm. This is the definition of "thin, intermediate aspect ratio" tabular grain emulsions employed by Abbott et al. U.S. Pat. No. 4,425,426.

In general tabular grains are preferred having a thickness of less than 0.3 μm, optimally less than 0.2 μm. For some applications, as where a photographic image is to be viewed without enlargement or in applications where granularity is of little importance, tabular grain thicknesses of up to 0.5 μm are acceptable. Such tabular grain thicknesses are illustrated by Jones et al. U.K. Specification No. 2,111,706A. The improvement of the present invention can, for example, be applied to reducing dye stain in a retained silver image produced according to the teachings of Jones et al. Intermediate aspect ratio tabular grain emulsions, particularly thin, intermediate aspect ratio tabular grain emulsions, have particular applicability to radiographic imaging, as taught by Abbott et al. U.S. Pat. No. 4,425,426, but can be applied generally to black and white photography. However, in general, the preferred tabular grain emulsions are high aspect ratio tabular grain emulsions. While the ensuing description is for convenience specifically directed to high aspect ratio tabular grain emulsions, it should be appreciated nevertheless that the teachings are generally applicable to tabular grain emulsions as herein defined.

The preferred high aspect ratio tabular grain silver halide emulsions are those wherein the silver halide grains having a thickness of less than 0.3 μm (optimally less than 0.2 μm) and a diameter of at least 0.6 μm have an average aspect ratio of at least 12:1 and optimally at least 20:1. In a preferred form of the invention these silver halide grains satisfying the above thickness and diameter criteria account for at least 70 percent and optimally at least 90 percent of the total projected area of the silver halide grains.

It is appreciated that the thinner the tabular grains accounting for a given percentage of the projected area, the higher the average aspect ratio of the emulsion. Typically the tabular grains have an average thickness of at least 0.03 μm, although even thinner tabular grains can in principal be employed.

High aspect ratio tabular grain emulsions useful in the practice of this invention can have extremely high average aspect ratios. Tabular grain average aspect ratios can be increased by increasing average grain diameters. This can produce sharpness advantages, but maximum average grain diameters are generally limited by granularity requirements for a specific photographic application. Tabular grain average aspect ratios can also or alternatively be increased by decreasing average grain thicknesses. When silver coverages are held constant, decreasing the thickness of tabular grains generally improves granularity as a direct function of increasing aspect ratio. Hence the maximum average aspect ratios of the tabular grain emulsions of this invention are a function of the maximum average grain diameters acceptable for the specific photographic application and the minimum attainable tabular grain thicknesses which can be produced. Maximum average aspect ratios have been observed to vary, depending upon the precipitation technique employed and the tabular grain halide composition. The highest observed average aspect ratios, 500:1, for tabular grains with photographically useful average grain diameters, have been achieved by Ostwald ripening preparations of silver bromide grains, with aspect ratios of 100:1, 200:1, or even higher being obtainable by double-jet precipitation procedures. Average aspect ratios as high as 50:1 or even 100:1 for silver chloride tabular grains, optionally containing bromide, can be prepared as taught by Maskasky U.S. Pat. No. 4,400,463, cited above.

The latent image forming grains can consist essentially of silver chloride or silver bromide as the sole silver halide. Alternatively, silver chloride or silver bromide can both be present within the same grains or in different grains of the same emulsion in any desired proportions, and the term "silver chlorobromide" is to be understood as embracing all such emulsions. The latent image forming silver halide grains are substantially free of iodide. That is, iodide concentrations are less than 0.5 mole percent, based on total silver. Typically iodide is present only in impurity concentrations.

Subject to the requirement that the latent image forming grains be substantially free of iodide, the tabular grain emulsions can be chosen from any of the various forms of tabular grain emulsions described in the patents cited above and in *Research Disclosure,* Vol. 225, January 1983, Item 22534, and any emulsions other than tabular grain emulsions present (e.g., octahedral, cubic, or complex grain emulsions) can take conventional forms, such as illustrated by *Research Disclosure,* Vol. 176, December 1978, Item 17643. *Research Disclosure* is published by Kenneth Mason Publications, Ltd., The Old Harbourmaster's, 8 North Street, Emsworth, Hampshire PO1O 7DD, England.

In a specifically preferred form one or more high aspect ratio tabular grain silver bromide emulsions are included in the photographic elements of this invention. According to one preferred procedure these emulsions can be formed by a double jet precipitation process similar to that taught by Wilgus et al. U.S. Pat. No. 4,434,226, except that the emulsions are substantially free of iodide. Into a conventional reaction vessel for silver halide precipitation equipped with an efficient stirring mechanism is introduced a dispersing medium. Typically the dispersing medium initially introduced into the reaction vessel is at least about 10 percent, preferably 20 to 80 percent, by weight based on total weight of the dispersing medium present in the silver bromide emulsion at the conclusion of grain precipitation. Since dispersing medium can be removed from the reaction vessel by ultrafiltration during silver bromide grain precipitation, as taught by Mignot U.S. Pat. No. 4,334,012, it is appreciated that the volume of dispersing medium initially present in the reaction vessel can equal or even exceed the volume of the silver bromide emulsion present in the reaction vessel at the conclusion of grain precipitation. The dispersing medium initially introduced into the reaction vessel is preferably water or a dispersion of peptizer in water, optionally containing other ingredients, such as one or more silver halide ripening agents and/or metal dopants, more specifically described below. Where a peptizer is initially present, it is preferably employed in a concentration of at least 10 percent, most preferably at least 20 percent, of the total peptizer present at the completion of silver bromide precipitation. Additional dispersing medium is added to the reaction vessel with the silver and bromide salts and can also be introduced through a separate jet. It is common practice to adjust the proportion of dispersing medium, particularly to increase the proportion of peptizer, after the completion of the salt introductions.

A minor portion, typically less than 10 percent, of the bromide salt employed in forming the silver bromide grains is initially present in the reaction vessel to adjust the bromide ion concentration of the dispersing medium at the outset of silver bromide precipitation. It is contemplated to maintain the pBr of the reaction vessel initially at or below 1.6, preferably below 1.5. On the other hand, if the pBr is too low, the formation of non-tabular silver bromide grains is favored. Therefore, it is contemplated to maintain the pBr of the reaction vessel at or above 0.6, preferably above 1.1. (As herein employed, pBr is defined as the negative logarithm of bromide ion concentration.)

During precipitation silver and bromide salts are added to the reaction vessel by techniques well known in the precipitation of silver bromide grains. Typically an aqueous solution of a soluble silver salt, such as silver nitrate, is introduced into the reaction vessel concurrently with the introduction of the bromide salt. The bromide salt is also typically introduced as an aqueous salt solution, such as an aqueous solution of one or more soluble alkali metal (e.g., sodium or potassium), or alkaline earth metal (e.g., magnesium or calcium) bromide salts.

With the introduction of silver salt into the reaction vessel the nucleation stage of grain formation is initiated. A population of grain nuclei is formed which is capable of serving as precipitation sites for silver bromide as the introduction of silver and bromide salts continues. The precipitation of silver bromide onto existing grain nuclei constitutes the growth stage of grain formation. The aspect ratios of the tabular grains formed according to this invention are less affected by bromide concentrations during the growth stage than during the nucleation stage. It is therefore possible during the growth stage to increase the permissible latitude of pBr during concurrent introduction of silver and bromide salts above 0.6, preferably in the range of from about 0.6 to 2.2, most preferably from about 0.8 to about 1.6, the latter being particularly preferred where a substantial rate of grain nuclei formation continues throughout the introduction of silver and bromide salts, such as in the preparation of highly polydispersed emulsions. Raising pBr values above 2.2 during tabular grain growth results in thickening of the grains, but can be tolerated in many instances while still realizing an average aspect ratio of greater than 8:1.

As an alternative to the introduction of silver and bromide salts as aqueous solutions, it is specifically contemplated to introduce the silver and bromide salts, initially or in the growth stage, in the form of fine silver bromide grains suspended in dispersing medium. The grain size is such that they are readily Ostwald ripened onto larger grain nuclei, if any are present, once introduced into the reaction vessel. The maximum useful grain sizes will depend on the specific conditions within the reaction vessel, such as temperature and the presence of solubilizing and ripening agents. (Since bromide is precipitated in preference to chloride, it is also possible to employ silver chlorobromide grains.) The silver halide grains are preferably very fine—e.g., less than 0.1 μm in mean diameter.

Subject to the pBr requirements set forth above, the concentrations and rates of silver and bromide salt introductions can take any convenient conventional form. The silver and halide salts are preferably introduced in concentrations of from 0.1 to 5 moles per liter, although broader conventional concentration ranges, such as from 0.01 mole per liter to saturation, for example, are contemplated. Specifically preferred precipitation techniques are those which achieve shortened precipitation times by increasing the rate of silver and halide salt introduction during the run. The rates of silver and bromide salt introduction can be increased either by increasing the rate at which the dispersing medium and the silver and bromide salts are introduced or by increasing the concentrations of the silver and bromide salts within the dispersing medium being introduced. It is specifically preferred to increase the rate of silver and bromide salt introduction, but to maintain the rate of introduction below the threshold level at which the formation of new grain nuclei is favored—i.e., to avoid renucleation, as taught by Irie U.S. Pat. No. 3,650,757, Kurz U.S. Pat. No. 3,672,900, Saito U.S. Pat. No.

4,242,445, Wilgus German OLS No. 2,107,118, Teitscheid et al. European patent application No. 80102242, and Wey "Growth Mechanism of AgBr Crystals in Gelatin Solution", *Photographic Science and Engineering,* Vol. 21, No. 1, January/February 1977, p. 14, et. seq. By avoiding the formation of additional grain nuclei after passing into the growth stage of precipitation, relatively monodisperse tabular silver bromide grain populations can be obtained. Emulsions having coefficients of variation of less than about 30 percent can be prepared. By intentionally favoring renucleation during the growth stage of precipitation, it is, of course, possible to produce polydisperse emulsions of substantially higher coefficients of variation.

Modifying compounds can be present during tabular silver bromide grain precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium, and tellurium), gold, and Group VIII noble metals, can be present during silver halide precipitation, as illustrated by Arnold et al. U.S. Pat. No. 1,195,432, Hochstetter U.S. Pat. No. 1,951,933, Trivelli et al. U.S. Pat. No. 2,448,060, Overman U.S. Pat. No. 2,628,167, Mueller et al. U.S. Pat. No. 2,950,972, Sidebotham U.S. Pat. No. 3,488,709, Rosecrants et al. U.S. Pat. No. 3,737,313, Berry et al. U.S. Pat. No. 3,772,031, Atwell U.S. Pat. No. 4,269,927, and *Research Disclosure,* Vol. 134, June 1975, Item 13452. The tabular grain silver bromide emulsions can be internally reduction sensitized during precipitation, as illustrated by Moisar et al., *Journal of Photographic Science,* Vol. 25, 1977, pp. 19–27.

The individual silver and bromide salts can be added to the reaction vessel through surface or subsurface delivery tubes by gravity feed or by delivery apparatus for maintaining control of the rate of delivery and the pH, pBr, and/or pAg of the reaction vessel contents, as illustrated by Culhane et al. U.S. Pat. No. 3,821,002, Oliver U.S. Pat. No. 3,031,304 and Claes et al., *Photographische Korrespondenz,* 102 Band, Number 10, 1967, p. 162. In order to obtain rapid distribution of the reactants within the reaction vessel, specially constructed mixing devices can be employed, as illustrated by Audran U.S. Pat. No. 2,996,287, McCrossen et al. U.S. Pat. No. 3,342,605, Frame et al. U.S. Pat. No. 3,415,650, Porter et al. U.S. Pat. No. 3,785,777, Finnicum et al. U.S. Pat. No. 4,147,551, Verhille et al. U.S. Pat. No. 4,171,224, Calamur U.K. patent application No. 2,022,431A, Saito et al. German OLS No. 2,555,364 and 2,556,885, and *Research Disclosure,* Volume 166, February 1978, Item 16662.

In forming the tabular grain silver bromide emulsions a dispersing medium is initially contained in the reaction vessel. In a preferred form the dispersing medium is comprised on an aqueous peptizer suspension. Peptizer concentrations of from 0.2 to about 10 percent by weight, based on the total weight of emulsion components in the reaction vessel, can be employed. It is common practice to maintain the concentration of the peptizer in the reaction vessel in the range of below about 6 percent, based on the total weight, prior to and during silver bromide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver bromide, preferably about 10 to 30 grams of peptizer per mole of silver bromide. Additional vehicle can be added later to bring the concentration up to as high as 1000 grams per mole of silver bromide. Preferably the concentration of vehicle in the finished emulsion is above 50 grams per mole of silver bromide. When coated and dried in forming a photographic element the vehicle preferably forms about 30 to 70 percent by weight of the emulsion layer.

It is specifically contemplated that grain ripening can occur during the preparation of high aspect ratio tabular grain silver bromide emulsions, and it is preferred that grain ripening occur within the reaction vessel during at least silver bromide grain formation. Known silver halide solvents are useful in promoting ripening. For example, an excess of bromide ions, when present in the reaction vessel, is known to promote ripening. It is therefore apparent that the bromide salt solution run into the reaction vessel can itself promote ripening. Other ripening agents can also be employed and can be entirely contained within the dispersing medium in the reaction vessel before silver and bromide salt addition, or they can be introduced into the reaction vessel along with one or more of the halide salt, silver salt, or peptizer. In still another variant the ripening agent can be introduced independently during bromide and silver salt additions. The preferred high aspect ratio tabular silver bromide emulsions are non-ammoniacal or neutral emulsions.

Among preferred ripening agents are those containing sulfur. Thiocyanate salts can be used, such as alkali metal, most commonly sodium and potassium, and ammonium thiocyanate salts. While any conventional quantity of the thiocyanate salts can be introduced, preferred concentrations are generally from about 0.1 to 20 grams of thiocyanate salt per mole of silver halide. Illustrative prior teachings of employing thiocyanate ripening agents are found in Nietz et al. U.S. Pat. No. 2,222,264, Lowe et al. U.S. Pat. No. 2,448,534, and Illingsworth U.S. Pat. No. 3,320,069. Alternatively, conventional thioether ripening agents, such as those disclosed in McBride U.S. Pat. No. 3,271,157, Jones U.S. Pat. No. 3,574,628, and Rosecrants et al. U.S. Pat. No. 3,737,313, can be employed.

The high aspect ratio tabular grain silver bromide emulsions are preferably washed to remove soluble salts. The soluble salts can be removed by decantation, filtration, and/or chill setting and leaching, as illustrated by Craft U.S. Pat. No. 2,316,845 and McFall et al. U.S. Pat. No. 3,396,027; by coagulation washing, as illustrated by Hewitson et al. U.S. Pat. No. 2,618,556, Yutzy et al. U.S. Pat. No. 2,614,928, Yackel U.S. Pat. No. 2,565,418, Hart et al U.S. Pat. No. 3,241,969, Waller et al. U.S. Pat. No. 2,489,341, Klinger U.K. Pat. No. 1,305,409 and Dersch et al. U.K. Pat. No. 1,167,159; by centrifugation and decantation of a coagulated emulsion, as illustrated by Murray U.S. Pat. No. 2,463,794, Ujihara et al. U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al. *Soviet Chemical Industry,* Vol. 6, No. 3, 1974, pp. 181–185; by diafiltration with a semipermeable membrane, as illustrated by *Research Disclosure,* Vol. 102, October 1972, Item 10208, Hagemaier et al. *Research Disclosure,* Vol. 131, March 1975, Item 13122, Bonnet *Research Disclosure,* Vol. 135, July 1975, Item 13577, Berg et al. German OLS No. 2,436,461, Bolton U.S. Pat. No. 2,495,918, and Mignot U.S. Pat. No. 4,334,012, cited above, or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure,* Vol. 101, September 1972, Item 10152. In the present invention washing is particularly advantageous in terminating ripening of the tabular grains after the completion of precipitation to avoid increasing their thickness and reducing their aspect ratio.

While the foregoing procedure constitutes a preferred double jet precipitation process for preparing high aspect ratio tabular grain silver bromide emulsions, it is recognized that departures therefrom can also produce high aspect ratio tabular grain silver bromide emulsions. For example, the preferred pBr ranges will shift under varied precipitation conditions, such in preparing ammoniacal emulsions or in varying concentrations or modifiers within the reaction vessel. High aspect ratio tabular grain silver bromide emulsions can alternatively be prepared following a procedure similar to that employed by de Cugnac and Chateau, "Evolution of the Morphology of Silver Bromide Crystals During Physical Ripening", *Science et Industries Photographiques,* Vol 33, No. 2, (1962), pp. 121-125. High aspect ratio silver bromide emulsions containing square and rectangular tabular grains can be prepared as taught by Mignot U.S. Pat. No. 4,386,156, noted above.

Although the procedures for preparing high aspect ratio tabular silver bromide grains described above will produce high aspect ratio tabular grain silver bromide emulsions in which tabular grains satisfying the thickness and diameter criteria for aspect ratio account for at least 50 percent of the total projected area of the total silver halide grain population, it is recognized that further advantages can be realized by increasing the proportion of such tabular grains present. Preferably at least 70 percent (optimally at least 90 percent) of the total projected area is provided by tabular silver bromide grains meeting the thickness and diameter criteria. While minor amounts of nontabular grains are fully compatible with many photographic applications, to achieve the full advantages of tabular grains the proportion of tabular grains can be increased. Larger tabular silver bromide grains can be mechanically separated from smaller, nontabular silver bromide grains in a mixed population of grains using conventional separation techniques—e.g., by using a centrifuge or hydrocyclone. An illustrative teaching of hydrocyclone separation is provided by Audran et al. U.S. Pat. No. 3,326,641.

Vehicles (including both binders and peptizers) which form the dispersing media of the emulsions can be chosen from among those conventionally employed in silver halide emulsions. Preferred peptizers are hydrophilic colloids, which can be employed alone or in combination with hydrophobic materials. Suitable hydrophilic materials include substances such as proteins, protein derivatives, cellulose derivatives—e.g., cellulose esters, gelatin—e.g., alkali-treated gelatin (cattle bone or hide gelatin), acid-treated gelatin (pigskin gelatin), or oxidizing agent-treated gelatin, gelatin derivatives—e.g., acetylated gelatin, phthalated gelatin, and the like, polysaccharides such as dextran, gum arabic, zein, casein, pectin, collagen derivatives, agar-agar, arrowroot, albumin and the like as described in Yutzy et al. U.S. Pat. Nos. 2,614,928 and '929, Lowe et al. U.S. Pat. Nos. 2,691,582, 2,614,930, '931, 2,327,808 and 2,448,534, Gates et al. U.S. Pat. Nos. 2,787,545 and 2,956,880, Corben et al. U.S. Pat. No. 2,890,215, Himmelmann et al. U.S. Pat. No. 3,061,436, Farrell et al. U.S. Pat. No. 2,816,027, Ryan U.S. Pat. Nos. 3,132,945, 3,138,461 and 3,186,846, Dersch et al. U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al. U.S. Pat. Nos. 2,992,213, 3,157,506, 3,184,312 and 3,539,353, Miller et al. U.S. Pat. No. 3,227,571, Boyer et al. U.S. Pat. No. 3,532,502, Malan U.S. Pat. No. 3,551,151, Lohmer et al. U.S. Pat. No. 4,018,609, Luciani et al. U.K. Pat. No. 1,186,790, Hori et al. U.K. Pat. No. 1,489,080 and Belgian Pat. No. 856,631, U.K. Pat. No. 1,490,644, U.K. Pat. No. 1,483,551, Arase et al. U.K. Pat. No. 1,459,906, Salo U.S. Pat. Nos. 2,110,491 and 2,311,086, Komatsu et al. Japanese Kokai Pat. No. Sho 58[1983]-70221, Fallesen U.S. Pat. No. 2,343,650, Yutzy U.S. Pat. No. 2,322,085, Lowe U.S. Pat. No. 2,563,791, Talbot et al. U.S. Pat. No. 2,725,293, Hilborn U.S. Pat. No. 2,748,022, DePauw et al. U.S. Pat. No. 2,956,883, Ritchie U.K. Pat. No. 2,095, DeStubner U.S. Pat. No. 1,752,069, Sheppard et al. U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al. U.S. Pat. No. 3,923,517.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al. U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al. U.S. Pat. Nos. 2,484,456, 2,541,474 and 2,632,704, Perry et al. U.S. Pat. No. 3,425,836, Smith et al. U.S. Pat. Nos. 3,415,653 and 3,615,624, Smith U.S. Pat. No. 3,488,708, Whiteley et al. U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al. U.S. Pat. No. 3,879,205, Nottorf U.S. Pat. No. 3,142,568, Houck et al. U.S. Pat. Nos. 3,062,674 and 3,220,844, Dann et al. U.S. Pat. No. 2,882,161, Schupp U.S. Pat. No. 2,579,016, Weaver U.S. Pat. No. 2,829,053, Alles et al. U.S. Pat. No. 2,698,240, Priest et al. U.S. Pat. No. 3,003,879, Merrill et al. U.S. Pat. No. 3,419,397, Stonham U.S. Pat. No. 3,284,207, Lohmer et al. U.S. Pat. No. 3,167,430, Williams U.S. Pat. No. 2,957,767, Dawson et al. U.S. Pat. No. 2,893,867, Smith et al. U.S. Pat. Nos. 2,860,986 and 2,904,539, Ponticello et al. U.S. Pat. Nos. 3,929,482 and 3,860,428, Ponticello U.S. Pat. No. 3,939,130, Dykstra U.S. Pat. No. 3,411,911 and Dykstra et al. Canadian Pat.

No. 774,054, Ream et al. U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al. U.S. Pat. Nos. 2,865,893 and 2,875,059, Rees et al. U.S. Pat. No. 3,536,491, Broadhead et al. U.K. Pat. No. 1,348,815, Taylor et al. U.S. Pat. No. 3,479,186, Merrill et al. U.S. Pat. No. 3,520,857, Bacon et al. U.S. Pat. No. 3,690,888, Bowman U.S. Pat. No. 3,748,143, Dickinson et al. U.K. Pat. Nos. 808,227 and '228, Wood U.K. Pat. No. 822,192 and Iguchi et al. U.K. Pat. No. 1,398,055. These additional materials need not be present in the reaction vessel during silver bromide precipitation, but rather are conventionally added to the emulsion prior to coating.

The vehicle materials, including particularly the hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers. The layers of the photographic elements containing crosslinkable colloids, particularly gelatin-containing layers, can be hardened by various organic or inorganic hardeners, such as those described by *Research Disclosure,* Item 17643, cited above, Section X. The tabular grain emulsion layers are preferably fully forehardened, as taught by Dickerson U.S. Pat. No. 4,414,304.

Although not essential to the practice of the invention, as a practical matter the latent image forming grains of the image recording emulsion layers are chemically sensitized. Chemical sensitization can occur either before or after spectral sensitization. Techniques for chemically sensitizing latent image forming silver halide grains are generally known to those skilled in the art and are summarized in *Research Disclosure,* Item 17643, cited above, Section III. The tabular grain latent image forming emulsions can be chemically sensitized as taught by Maskasky U.S. Pat. No. 4,435,501 or Kofron et al. U.S. Pat. No. 4,439,520, both cited above.

It is specifically contemplated to employ in combination with the tabular grain emulsions and, preferably, other latent image forming emulsions, if any, forming a part of the photographic elements spectral sensitizing dyes that exhibit absorption maxima in the visible spectrum. In addition, for specialized applications, spectral sensitizing dyes can be employed which improve spectral response beyond the visible spectrum. For example, the use of infrared absorbing spectral sensitizers is specifically contemplated.

The latent image forming silver halide emulsions can be spectrally sensitized with dyes from a variety of classes, including the polymethine dye class, which classes include the cyanines, merocyanines, complex cyanines and merocyanines (i.e., tri-, tetra-, and polynuclear cyanines and merocyanines), oxonols, hemioxonols, styryls, merostyryls, and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, oxazolinium, thiazolium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium, and imidazopyrazinium quaternary salts.

The merocyanine spectral sensitizing dyes include, joined by a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", *Photographic Science and Engineering,* Vol. 18, 1974, pp. 418–430.

Spectral sensitizing dyes also affect the emulsions in other ways. Spectral sensitizing dyes can also function as antifoggants or stabilizers, development accelerators or inhibitors, and halogen acceptors or electron acceptors, as disclosed in Brooker et al. U.S. Pat. No. 2,131,038 and Shiba et al U.S. Pat. No. 3,930,860.

Sensitizing action can be correlated to the position of molecular energy levels of a dye with respect to ground state and conduction band energy levels of the silver halide crystals. These energy levels can in turn be correlated to polarographic oxidation and reduction potentials, as discussed in *Photographic Science and Engineering,* Vol. 18, 1974, pp. 49–53 (Sturmer et al), pp. 175–178 (Leubner) and pp. 475–485 (Gilman). Oxidation and reduction potentials can be measured as described by R. F. Large in *Photographic Sensitivity,* Academic Press, 1973, Chapter 15.

The chemistry of cyanine and related dyes is illustrated by Weissberger and Taylor, *Special Topics of Heterocyclic Chemistry,* John Wiley and Sons, New York, 1977, Chapter VIII; Venkataraman, *The Chemistry of Synthetic Dyes,* Academic Press, New York, 1971, Chapter V; James, *The Theory of the Photographic Process.* 4th Ed., Macmillan, 1977, Chapter 8, and F. M.

Hamer, *Cyanine Dyes and Related Compounds,* John Wiley and Sons, 1964.

Among useful spectral sensitizing dyes for sensitizing silver halide emulsions are those found in U.K. Pat. No. 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,231,658, 2,493,747, '748, 2,526,632, 2,739,964 (U.S. Pat. No. Re. 24,292), 2,778,823, 2,917,516, 3,352,857, 3,411,916 and 3,431,111, Wilmanns et al U.S. Pat. No. 2,295,276, Sprague U.S. Pat. Nos. 2,481,698 and 2,503,776, Carroll et al U.S. Pat. Nos. 2,688,545 and 2,704,714, Larive et al U.S. Pat. No. 2,921,067, Jones U.S. Pat. No. 2,945,763, Nys et al U.S. Pat. No. 3,282,933, Schwan et al U.S. Pat. No. 3,397,060, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349. Examples of useful dye combinations, including supersensitizing dye combinations, are found in Motter U.S. Pat. No. 3,506,443 and Schwan et al U.S. Pat. No. 3,672,898. As examples of supersensitizing combinations of spectral sensitizing dyes and non-light absorbing addenda, it is specifically contemplated to employ thiocyanates during spectral sensitization, as taught by Leermakers U.S. Pat. No. 2,221,805; bis-triazinylaminostilbenes, as taught by McFall et al U.S. Pat. No. 2,933,39; sulfonated aromatic compounds, as taught by Jones et al U.S. Pat. No. 2,937,089; mercapto-substituted heterocycles, as taught by Riester U.S. Pat. No. 3,457,078; iodide, as taught by U.K. Specification No. 1,413,826; and still other compounds, such as those disclosed by Gilman, "Review of the Mechanisms of Supersensitization", cited above.

Conventional amounts of dyes can be employed in spectrally sensitizing the emulsion layers containing nontabular or low aspect ratio tabular silver halide grains. To realize the full advantages of this invention it is preferred to adsorb spectral sensitizing dye to the grain surfaces of the tabular grain emulsions in a substantially optimum amount—that is, in an amount sufficient to realize at least 60 percent of the maximum photographic speed attainable from the grains under contemplated conditions of exposure. The quantity of dye employed will vary with the specific dye or dye combination chosen as well as the size and aspect ratio of the grains. It is known in the photographic art that optimum spectral sensitization is obtained with organic dyes at about 25 to 100 percent or more of monolayer coverage of the total available surface area of surface sensitive silver halide grains, as disclosed, for example, in West et al, "The Adsorption of Sensitizing Dyes in Photographic Emulsions", *Journal of Phys. Chem.,* Vol 56, p. 1065, 1952; Spence et al, "Desensitization of Sensitizing Dyes", *Journal of Physical and Colloid Chemistry,* Vol. 56, No. 6, June 1948, pp. 1090–1103; and Gilman et al U.S. Pat. No. 3,979,213. Optimum dye concentration levels can be chosen by procedures taught by Mees, *Theory of the Photographic Process,* Macmillan, 1942, pp. 1067–1069.

Although the native blue sensitivity of silver bromide can be relied upon to record exposure to blue light, it is specifically recognized that advantages can be realized from the use of blue spectral sensitizing dyes. Where it is intended to expose tabular grain emulsions in their region of native sensitivity, advantages in sensitivity can be gained by increasing the thickness of the tabular grains. Specifically, in one preferred form of the invention the tabular grain emulsions are blue sensitized silver bromide emulsions in which the tabular grains having a thickness of less than 0.5 μm and a diameter of at least 0.6 μm have an average aspect ratio of greater than 8:1, preferably at least 12:1 and account for at least 50 percent of the total projected area of the silver halide grains present in the emulsion, preferably 70 percent and optimally at least 90 percent.

Useful blue spectral sensitizing dyes for tabular grain emulsions can be selected from any of the dye classes known to yield spectral sensitizers. Polymethine dyes, such as cyanines, merocyanines, hemicyanines, hemioxonols, and merostyryls, are preferred blue spectral sensitizers. Generally useful blue spectral sensitizers can be selected from among these dye classes by their absorption characteristics—i.e., hue. There are, however, general structural correlations that can serve as a guide in selecting useful blue sensitizers. Generally the shorter the methine chain, the shorter the wavelength of the sensitizing maximum. Nuclei also influence absorption. The addition of fused rings to nuclei tends to favor longer wavelengths of absorption. Substituents can also alter absorption characteristics. In the formulae which follow, unless otherwise specified, alkyl groups and moieties contain from 1 to 20 carbon atoms, preferably from 1 to 8 carbon atoms. Aryl groups and moieties contain from 6 to 15 carbon atoms and are preferably phenyl or naphthyl groups or moieties.

Preferred cyanine blue spectral sensitizers are monomethine cyanines; however, useful cyanine blue spectral sensitizers can be selected from among those of Formula 1.

Formula 1

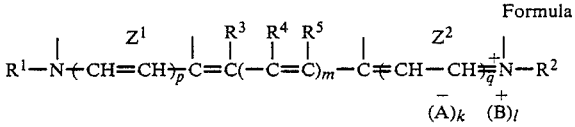

where $Z^1$ and $Z^2$ may be the same or different and each represents the elements needed to complete a cyclic nucleus derived from basic heterocyclic nitrogen compounds such as oxazoline, oxazole, benzoxazole, the naphthoxazoles (e.g., naphth[2,1-d]oxazole, naphth[2,3-d]oxazole, and naphth[1,2-d]oxazole), thiazoline, thiazole, benzothiazole, the naphthothiazoles (e.g., naphtho[2,1-d]thiazole), the thiazoloquinolines (e.g., thiazolo[4,5-b]quinoline), selenazoline, selenazole, benzoselenazole, the naphthoselenazoles (e.g., naphtho[1,2-d]selenazole), 3H-indole (e.g., 3,3-dimethyl-3H-indole), the benzindoles (e.g., 1,1-dimethylbenz[e]indole), imidazoline, imidazole, benzimidazole, the naphthimidazoles (e.g., naphth[2,3-d]imidazole), pyridine, and quinoline, which nuclei may be substituted on the ring by one or more of a wide variety of substituents such as hydroxy, the halogens (e.g., fluoro, chloro, bromo, and iodo), alkyl groups or substituted alkyl groups (e.g., methyl, ethyl, propyl, isopropyl, butyl, octyl, dodecyl, octadecyl, 2-hydroxyethyl, 3-sulfopropyl, carboxymethyl, 2-cyanoethyl, and trifluoromethyl), aryl groups or substituted aryl groups (e.g., phenyl, 1-naphthyl, 2-naphthyl, 4-sulfophenyl, 3-carboxyphenyl, and 4-biphenyl), aralkyl groups (e.g., benzyl and phenethyl), alkoxy groups (e.g., methoxy, ethoxy, and isopropoxy), aryloxy groups (e.g., phenoxy and 1-naphthoxy), alkylthio groups (e.g., methylthio and ethylthio), arylthio groups (e.g., phenylthio, p-tolythio, and 2-naphthylthio), methylenedioxy, cyano, 2-thienyl, styryl, amino or substituted amino groups (e.g., anilino, dimethylamino, diethylamino, and morpholino), acyl groups, such as carboxy (e.g., acetyl and benzoyl) and sulfo;

$R^1$ and $R^2$ can be the same or different and represent alkyl groups, aryl groups, alkenyl groups, or aralkyl groups, with or without substituents, (e.g., carboxymethyl, 2-hydroxyethyl, 3-sulfopropyl, 3-sulfobutyl, 4-sulfobutyl, 4-sulfophenyl, 2-methoxyethyl, 2-sulfatoethyl, 3-thiosulfatopropyl, 2-phosphonoethyl, chlorophenyl, and bromophenyl);

$R^3$ represents hydrogen;

$R^4$ and $R^5$ represents hydrogen or alkyl of from 1 to 4 carbon atoms;

p and q are 0 or 1, except that both p and q preferably are not 1;

m is 0 or 1 except that when m is 1 both p and q are 0 and at least one of $Z^1$ and $Z^2$ represents imidazoline, oxazoline, thiazoline, or selenazoline;

A is an anionic group;

B is a cationic group; and k and l may be 0 or 1, depending on whether ionic substituents are present. Variants are, of course, possible in which $R^1$ and $R^3$, $R^2$ and $R^5$, or $R^1$ and $R^2$ (particularly when m, p, and q are 0) together represent the atoms necessary to complete an alkylene bridge.

Some representative cyanine dyes useful as blue sensitizers are listed in Table I.

TABLE I 1. 3,3'-Diethylthiacyanine bromide

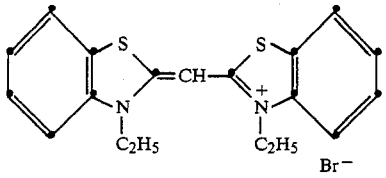

2. 1-Ethyl-3'-methyl-4'-phenylnaphtho[1,2-d]thiazololthiazolinocyanine bromide

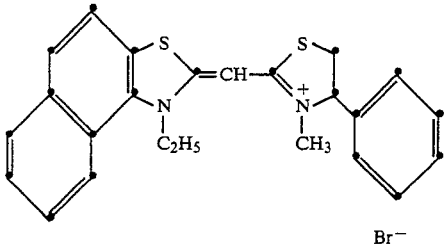

3. 1',3-Diethyl-4-phenyloxazolo-2'-cyanine iodide

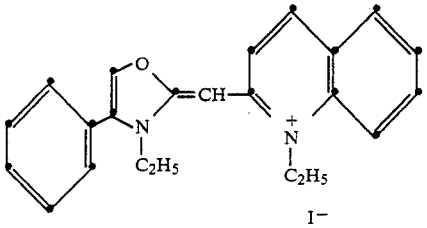

4. Anhydro 5-chloro-5'-methoxy-3,3'-bis-(2-sulfoethyl)thiacyanine hydroxide, triethylamine salt TABLE I-continued

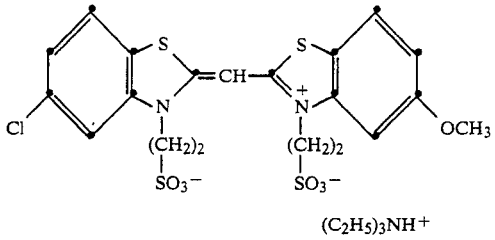

5. 3,3'-Bis(2-carboxyethyl)thiazolinocarbocyanine iodide

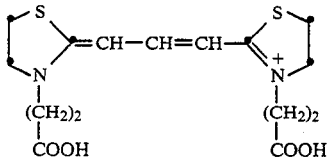

6. 1,1'-Diethyl-3,3'-ethylenebenzimidazolocyanine iodide

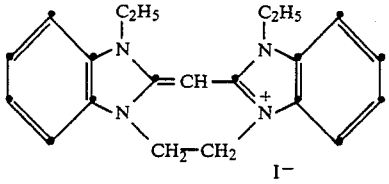

7. 1-(3-Ethyl-2-benzothizolinylidene)-1,2,3,4-tetrahydro-2-methylpyrido-[2,1-b]-benzothiazolinium iodide

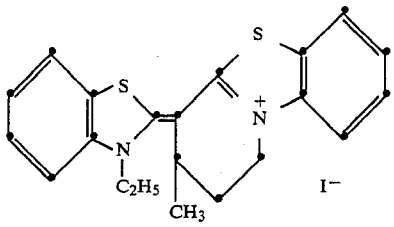

8. Anhydro-5,5'-dimethoxy-3,3'-bis(3-sulfopropyl)thiacyanine hydroxide, sodium salt

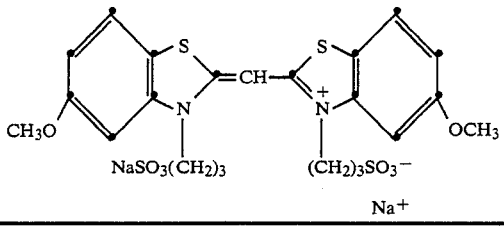

Preferred merocyanine blue spectral sensitizers are zero methine merocyanines; however, useful merocyanine blue spectral sensitizers can be selected from among those of Formula 2.

Formula 2

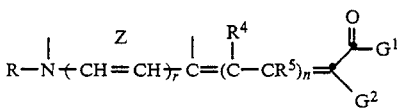

where

Z represents the same elements as either $Z^1$ or $Z^2$ of Formula 1 above;

R represents the same groups as either $R^1$ or $R^2$ of Formula 1 above;

$R^4$ and $R^5$ represent hydrogen, an alkyl group of 1 to 4 carbon atoms, or an aryl group (e.g., phenyl or naphthyl);

$G^1$ represents an alkyl group or substituted alkyl group, an aryl or substituted aryl group, an aralkyl group, an alkoxy group, an aryloxy group, a hydroxy group, an amino group, a substituted amino group wherein specific groups are of the types in Formula 1;

$G^2$ can represent any one of the groups listed for $G^1$ and in addition can represent a cyano group, an alkyl, or arylsulfonyl group, or a group represented by $$-\underset{\underset{O}{\|}}{C}-G^1,$$

or $G^2$ taken together with $G^1$ can represent the elements needed to complete a cyclic acidic nucleus such as those derived from 2,4-oxazolidinone (e.g., 3-ethyl-2,4-oxazolidindione), 2,4-thiazolidindione (e.g., 3-methyl-2,4-thiazolidindione), 2-thio-2,4-oxazolidindione (e.g., 3-phenyl-2-thio-2,4-oxazolidindione), rhodanine, such as 3-ethylrhodanine, 3-phenylrhodanine, 3-(3-dimethylaminopropyl)rhodanine, and 3-carboxymethylrhodanine, hydantoin (e.g., 1,3-diethylhydantoin and 3-ethyl-1-phenylhydantoin), 2-thiohydantoin (e.g., 1-ethyl-3-phenyl-2-thiohydantoin, 3-heptyl-1-phenyl-2-thiohydantoin, and 1,3-diphenyl-2-thiohydantoin), 2-pyrazolin-5-one, such as 3-methyl-1-phenyl-2-pyrazolin-5-one, 3-methyl-1-(4-carboxybutyl)-2-pyrazolin-5-one, and 3-methyl-2-(4-sulfophenyl)-2-pyrazolin-5-one, 2-isoxazolin-5-one (e.g., 3-phenyl-2-isoxazolin-5-one), 3,5-pyrazolidindione (e.g., 1,2-diethyl-3,5-pyrazolidindione and 1,2-diphenyl-3,5-pyrazolidindione), 1,3-indandione, 1,3-dioxane-4,6-dione, 1,3-cyclohexanedione, barbituric acid (e.g., 1-ethylbarbituric acid and 1,3-diethylbarbituric acid), and 2-thiobarbituric acid (e.g., 1,3-diethyl-2-thiobarbituric acid and 1,3-bis(2-methoxyethyl)-2-thiobarbituric acid);

r and n each can be 0 or 1 except that when n is 1 then generally either Z is restricted to imidazoline, oxazoline, selenazoline, thiazoline, imidazoline, oxazole, or benzoxazole, or $G^1$ and $G^2$ do not represent a cyclic system. Some representative blue sensitizing merocyanine dyes are listed below in Table II.

TABLE II 1. 5-(3-Ethyl-2-benzoxazolinylidene)-3-phenylrhodanine

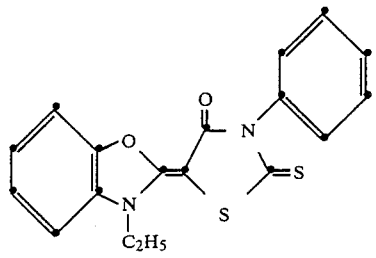

2. 5-[1-(2-Carboxyethy)-1,4-dihydro-4-pyridinylidene-1-ethyl-3-phenyl-2-thiohydantoin TABLE II-continued

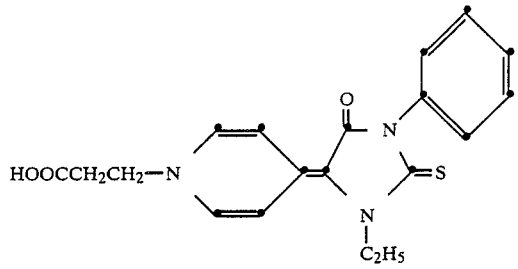

3. 4-(3-Ethyl-2-benzothiazolinylidene)-3-methyl-1-(4-sulfophenyl)-2-pyrazolin-5-one, potassium salt

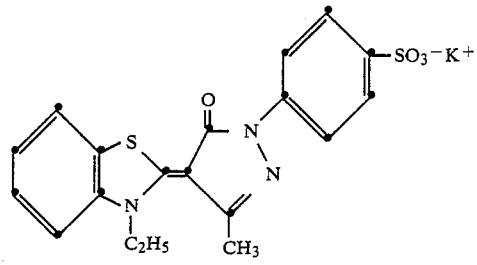

4. 3-Carboxymethyl-5-(5-chloro-3-ethyl-2-benzothiazolinylidene)rhodanine

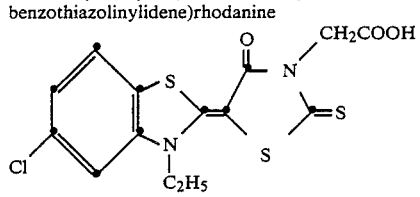

5. 1,3-Diethyl-5-[3,4,4-trimethyloxazolidinylidene)ethylidene]-2-thiobarbituric acid

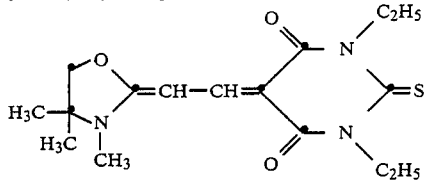

Useful blue sensitizing hemicyanine dyes include those represented by Formula 3.

Formula 3

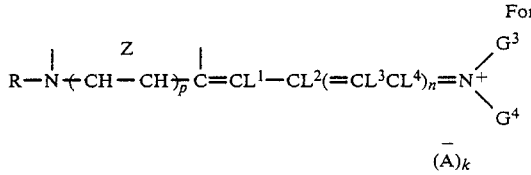

where

Z, R, and p represent the same elements as in Formula 2; $G^3$ and $G^4$ may be the same or different and may represent alkyl, substituted alkyl, aryl, substituted aryl, or aralkyl, as illustrated for ring substituents in Formula 1 or $G^3$ and $G^4$ taken together complete a ring system derived from a cyclic secondary amine, such as pyrrolidine, 3-pyrroline, piperidine, piperazine (e.g., 4-methylpiperazine and 4-phenylpiperazine), morpholine, 1,2,3,4-tetrahydroquinoline, decahydroquinoline, 3-azabicyclo[3,2,2]nonane, indoline, azetidine, and hexahydroazepine;

$L^1$ to $L^4$ represent hydrogen, alkyl of 1 to 4 carbons, aryl, substituted aryl, or any two of $L^1$, $L^2$, $L^3$, $L^4$ can represent the elements needed to complete an alkylene or carbocyclic bridge;

n is 0 or 1; and

A and k have the same definition as in Formula 1.

Some representative blue sensitizing hemicyanine dyes are listed below in Table III.

TABLE III 1. 5,6-Dichloro-2-[4-(diethylamino)-1,3-butandien-1-yl]-1,3-diethylbenzimidazolium iodide

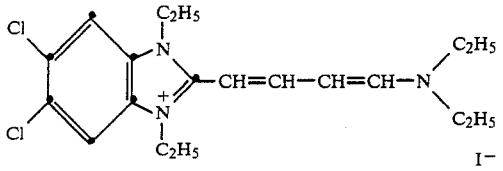

2. 2-{2-[2-(3-Pyrrolino)-1-cyclopenten-1-yl]ethenyl}3-ethylthiazolinium perchlorate

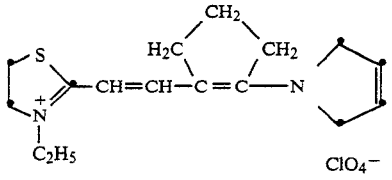

3. 2-(5,5-Dimethyl-3-piperidino-2-cyclohexen-1-yldenemethyl)-3-ethylbenzoxazolium perchlorate

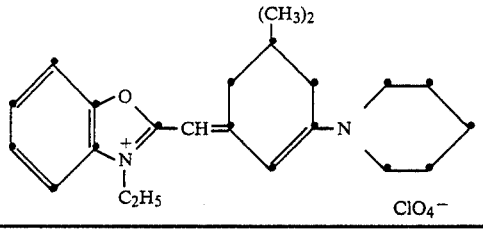

Useful blue sensitizing hemioxonol dyes include those represented by Formula 4.

Formula 4

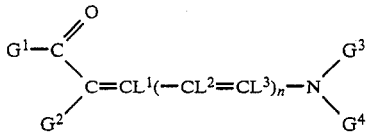

where $G^1$ and $G^2$ represent the same elements as in Formula 2;

$G^3$, $G^4$, $L^1$, $L^2$, and $L^3$ represent the same elements as in Formula 3; and n is 0 or 1.

Some representative blue sensitizing hemioxonol dyes are listed in Table IV.

TABLE IV 1. 5-(3-Anilino-2-propen-1-ylidene)-1,3-diethyl-2-thiobarbituric acid

TABLE IV-continued

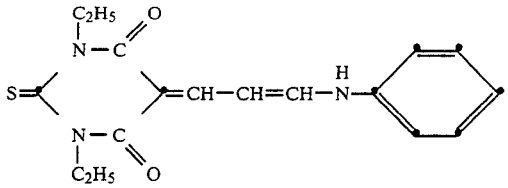

2. 3-Ethyl-5-(3-piperidino-2-propen-1-ylidene)rhodanine

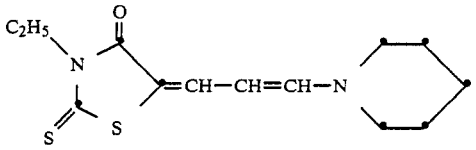

3. 3-Allyl-5-[5,5-dimethyl-3-(3-pyrrolino)-2-cyclohexen-1-ylidene]rhodanine

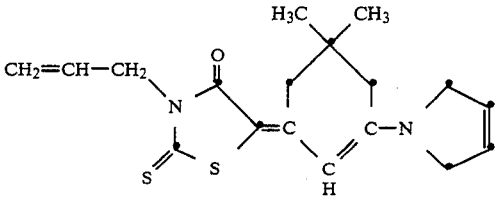

Useful blue sensitizing merostyryl dyes include those represented by Formula 5.

Formula 5

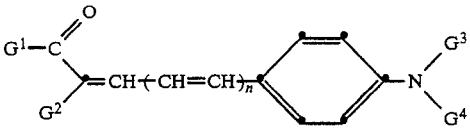

$G^1$, $G^2$, $G^3$, $G^4$, and n are as defined in Formula 4.

Some representative blue sensitizing merostyryl dyes are listed in Table V.

TABLE V 1. 1-Cyano-1-(4-dimethylaminobenzylidene)-2-pentanone

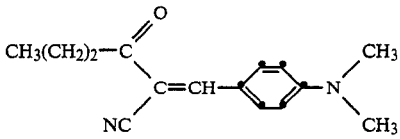

2. 5-(4-Dimethylaminobenzylidene-2,3-diphenylthiazolidin-4-one-1-oxide

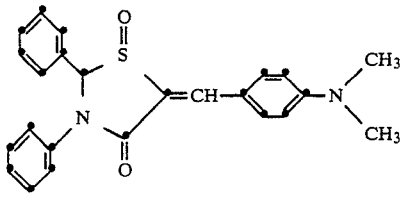

3. 2-(4-Dimethylaminocinnamylidene)thiazolo-[3,2-a]benzimidazol-3-one

TABLE V-continued

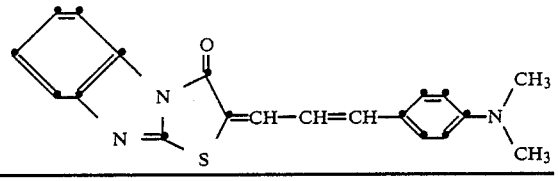

Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrently with chemical sensitization, can entirely precede chemical sensitization, and can even commence prior to the completion of silver halide grain precipitation as taught by Philippaerts et al U.S. Pat. No. 3,628,960, and Locker et al U.S. Pat. No. 4,225,666. As taught by Locker et al, it is specifically contemplated to distribute introduction of the spectral sensitizing dye into the emulsion so that a portion of the spectral sensitizing dye is present prior to chemical sensitization and a remaining portion is introduced after chemical sensitization. Unlike Locker et al, it is specifically contemplated that the spectral sensitizing dye can be added to the emulsion after 80 percent of the silver halide has been precipitated. Sensitization can be enhanced by pAg adjustment, including variation in pAg which completes one or more cycles, during chemical and/or spectral sensitization. A specific example of pAg adjustment is provided by *Research Disclosure,* Vol. 181, May 1979, Item 18155.

As taught by Kofron et al U.S. Pat. No. 4,439,520, high aspect ratio tabular grain silver halide emulsions can exhibit better speed-granularity relationships when chemically and spectrally sensitized than have heretofore been achieved using conventional silver halide emulsions of like halide content.

In one preferred form, spectral sensitizers can be incorporated in the tabular grain emulsions prior to chemical sensitization. Similar results have also been achieved in some instances by introducing other adsorbable materials, such as finish modifiers, into the emulsions prior to chemical sensitization.

Independent of the prior incorporation of adsorbable materials, it is preferred to employ thiocyanates during chemical sensitization in concentrations of from about $2\times10^{-3}$ to 2 mole percent, based on silver, as taught by Damschroder U.S. Pat. No. 2,642,361, cited above. Other ripening agents can be used during chemical sensitization.

In still a third approach, which can be practiced in combination with one or both of the above approaches or separately thereof, it is preferred to adjust the concentration of silver and/or halide salts present immediately prior to or during chemical sensitization. Soluble silver salts, such as silver acetate, silver trifluoroacetate, and silver nitrate, can be introduced as well as silver salts capable of precipitating onto the grain surfaces, such as silver thiocyanate, silver phosphate, silver carbonate, and the like. Fine silver halide (i.e., silver bromide and/or chloride) grains capable of Ostwald ripening onto the tabular grain surfaces can be introduced. For example, a Lippmann emulsion can be introduced during chemical sensitization. Maskasky U.S. Pat. No. 4,435,501, discloses the chemical sensitization of spectrally sensitized high aspect ratio tabular grain emulsions at one or more ordered discrete sites of the tabular grains. It is believed that the preferential adsorption of spectral sensitizing dye on the crystallographic surfaces forming the major faces of the tabular grains allows chemical sensitization to occur selectively at unlike crystallographic surfaces of the tabular grains.

The preferred chemical sensitizers for the highest attained speed-granularity relationships are gold and sulfur sensitizers, gold and selenium sensitizers, and gold, sulfur, and selenium sensitizers. Thus, in a preferred form, the high aspect ratio tabular grain silver bromide emulsions contain a middle chalcogen, such as sulfur and/or selenium, which may not be detectable, and gold, which is detectable. The emulsions also usually contain detectable levels of thiocyanate, although the concentration of the thiocyanate in the final emulsions can be greatly reduced by known emulsion washing techniques. In various of the preferred forms indicated above the tabular silver bromide grains can have another silver salt at their surface, such as silver thiocyanate or another silver chloride, although the other silver salt may be present below detectable levels.

Although not required to realize all of their advantages, the image recording emulsions are preferably, in accordance with prevailing manufacturing practices, substantially optimally chemically and spectrally sensitized. That is, they preferably achieve speeds of at least 60 percent of the maximum log speed attainable from the grains in the spectral region of sensitization under the contemplated conditions of use and processing. Log speed is herein defined as 100 (1−log E), where E is measured in meter-candle-seconds at a density of 0.1 above fog. Once the silver halide grains of an emulsion layer have been characterized, it is possible to estimate from further product analysis and performance evaluation whether an emulsion layer of a product appears to be substantially optimally chemically and spectrally sensitized in relation to comparable commercial offerings of other manufacturers.

In addition to the silver halide grains, spectral and chemical sensitizers, vehicles, and hardeners described above, the photographic elements can contain in the emulsion or other layers thereof brighteners, antifoggants, stabilizers, scattering or absorbing materials, coating aids, plasticizers, lubricants, and matting agents, as described in *Research Disclosure,* Item 17643, cited above, Sections V, VI, VII, XI, XII, and XVI. Methods of addition and coating and drying procedures can be employed, as described in Section XIV and XV. Conventional photographic supports can be employed, as described in Section XVII. These photographic elements are capable of producing stable, viewable silver images on development in aqueous alkaline processing solutions and fixing out.

In a preferred form the silver image producing photographic elements of this invention are radiographic elements. In addition to the features specifically described above the radiographic elements of this invention can include additional features conventional in radiographic applications. Exemplary features of this type are disclosed, for example, in *Research Disclosure,* Vol. 184, August 1979, Item 18431. For example, the emulsions can contain antikink agents, as set forth in Paragraph II. The radiographic element can contain antistatic agents and/or layers, as set forth in Paragraph III. The radiographic elements can contain overcoat layers, as set out in Paragraph IV.

Preferred radiographic elements are of the type disclosed by Abbott et al U.S. Pat. Nos. 4,425,425 and 4,425,426, cited above. That is, at least one tabular grain emulsion layer is incorporated in each of two imaging units located on opposite major surfaces of a support capable of permitting substantially specular transmission of imaging radiation. Such radiographic supports are most preferably polyester film suports. Poly(ethylene terephthalate) film supports are specifically preferred. Such supports as well as their preparation are disclosed in Scarlett U.S. Pat. No. 2,823,421, Alles U.S. Pat. No. 2,779,684, and Arvidson and Stottlemyer U.S. Pat. No. 3,939,000. Medical radiographic elements are usually blue tinted. Generally the tinting dyes are added directly to the molten polyester prior to extrusion and therefore must be thermally stable. Preferred tinting dyes are anthraquinone dyes, such as those disclosed by Hunter U.S. Pat. No. 3,488,195, Hibino et al U.S. Pat. No. 3,849,139, Arai et al U.S. Pat. Nos. 3,918,976 and 3,933,502, Okuyama et al U.S. Pat. No. 3,948,664, and U.K. Pat. Nos. 1,250,983 and 1,372,668. The crossover advantages resulting from employing tabular grain emulsions as taught by Abbott et al can be further improved by employing conventional crossover exposure control approaches, as disclosed in Item 18431, Paragraph V.

The preferred spectral sensitizing dyes for these radiographic elements are chosen to exhibit an absorption peak shift in their adsorbed state, usually in the H or J band, to a region of the spectrum corresponding to the wavelength of electromagnetic radiation to which the element is intended to be imagewise exposed. The electromagnetic radiation producing imagewise exposure is typically emitted from phosphors of intensifying screens. A separate intensifying screen exposes each of the two imaging units located on opposite sides of the support. The intensifying screens can emit light in the ultraviolet, blue, green, or red portions of the spectrum, depending upon the specific phosphors chosen for incorporation therein. In a specifically preferred form of the invention the spectral sensitizing dye is a carbocyanine dye exhibiting a J band absorption when adsorbed to the tabular grains in a spectral region corresponding to peak emission by the intensifying screen, usually the green region of the spectrum.

The intensifying screens can themselves form a part of the radiographic elements, but usually they are separate elements which are reused to provide exposures of successive radiographic elements. Intensifying screens are well known in the radiographic art. Conventional intensifying screens and their components are disclosed by *Research Discloure.* Vol. 18431, cited above, Paragraph IX, and by Rosecrants U.S. Pat. No. 3,737,313.

To obtain a viewable silver image the photographic or, in preferred applications, radiographic elements are developed in an aqueous alkaline processing solution, such as an aqueous alkaline developer solution or, where the developing agent is incorporated in the photographic element, in an aqueous alkaline activator solution. To enhance silver covering power development can be undertaken as taught by Dickerson U.S. Pat. No. 4,414,304. In the practice of this invention direct or chemical development is favored over physical development. Following development the residual silver halide is removed from the photographic elements of this invention by fixing out. This avoids an increase in minimum density attributable to delayed conversion of silver halide to silver. In other words, it renders the silver image produced by development stable. Development and fixing out together with other optional, but common attendant steps, such as stopping development, washing, toning, and drying, can be undertaken following practices well known in the art, such as the materials and procedures useful for silver imaging identified in *Research Disclosure,* Item 17643, cited above, Sections XIX, XX, and XXI.

EXAMPLES

The invention can be better appreciated by reference to the following specific examples:

EXAMPLES 1 through 5

These examples illustrate a reduction of dye stain in an X-ray film having a negative working latent image forming tabular grain silver bromide emulsion layer and a gelatin overcoat. Silver iodide is present in either the emulsion layer or overcoat in the example X-ray films and absent from the X-ray films identified as controls.

To prepare the X-ray films a high aspect ratio tabular grain silver bromide emulsion was employed wherein greater than 50 percent of the total grain projected area was accounted for by tabular grains having an average diameter of about 1.6 μm, a thickness of about 0.11 μm, and an average aspect rato of about 14:1. The tabular grain emulsion was optimally spectrally sensitized with anhydro-5,5'-dichloro-9-ethyl-3,3'-di(3-sulfopropyl)oxacarbocyanine hydroxide (hereinafter referred to as Dye I). For super sensitization about $2.4\times10^{-1}$ percent by weight, based on total halide, iodide in the form of potassium iodide was added to the emulsion after addition of the dye. The emulsion was coated on a polyester film support at 1.98 g/m$^2$ silver and 2.92 g/m$^2$ gelatin. The gelatin overcoat was applied at 0.91 g/m$^2$ gelatin. The coating was hardened with bis(vinylsulfonylmethyl) ether at 2.5% of the total gelatin.

In the example X-ray films a 0.08 μm silver iodide emulsion was added either to the tabular grain silver bromide emulsion forming the emulsion layer or to the gelatin forming the overcoat at the levels of silver indicated in Table VI. All emulsion melts were held at 40° C. for about 8 hours.

Samples of the X-ray films were exposed through a graduated density step tablet to a MacBeth ® sensitometer for 1/50th second to a 500 watt General Electric DMX ® projector lamp calibrated to 2650° K. filtered with a Corning C4010 ® filter to simulate a green emitting X-ray screen exposure. The X-ray film samples were then processed through an Eastman Kodak RP X-Omat ® roller transport processor, Model M8. Processing was by development in Kodak RP X-Omat Developer MX-1166 ® for 21 seconds at 35.5° C. followed by fixing in Kodak RP X-Omat Fixer MX-1088° for 16.5 seconds at 35° C. To complete fixing out the X-ray film samples were washed in deionized water for 12 seconds at 8.5° C.

The sensitometric results are tabulated in Table VI. Maximum and minimum densities were measured with neutral white light extending over the entire visible spectrum. Residual dye stain was measured as the difference between density at 505 nm, which corresponds to the dye absorption peak, and the density at 400 nm. Dye stain was measured in minimum density areas of the X-ray film samples as well as at density levels of 0.25, 0.50, and 0.75.

As shown in Table VI, dye stain in the control coating was at its maximum in minimum density areas and decreased slightly in 0.25, 0.50, and 0.75 density areas. Addition of the silver iodide emulsion to the tabular grain silver bromide emulsion caused a slight increase in dye stain in minimum density areas, but lowered dye density in 0.50 and 0.75 density areas with the net effect being a pronounced lowering of dye stain. When silver iodide was added to the overcoat layer, dye stain was lowered in minimum density as well as 0.25, 0.50, and 0.75 density areas. Although the 8 hour melt holding of the silver iodide in the tabular grain silver bromide emulsion prior to coating resulted in a loss of sensitivity, no sensitivity loss was experienced when the silver iodide was added to the overcoat. The unusually long melt hold was intended to exaggerate the effect of the silver iodide in the tabular grain silver bromide emulsion and could easily have been minimized to reduce loss of sensitivity.

To demonstrate the restricted scope of the dye stain problem a control X-ray film was prepared and processed as described above, differing only by the features specifically identified below. An approximately spherical grain silver bromoiodide emulsion containing 3.4 mole percent iodide, based on total halide, and having a mean grain diameter of 0.75 μm was optimally spectrally sensitized with Dye I and anhydro-5-chloro-9-ethyl-5'-phenyl-3'-(3-sulfobutyl)3-(3-sulfpropyl)oxacarbocyanine hydroxide, sodium salt. The emulsion was coated at 2.47 g/m$^2$ silver and 2.85 g/m$^2$ gelatin. Since no silver iodide was added, the 8 hour melt hold was omitted.

The results, reported in Table VI, show a comparable green speed, but with greatly reduced dye stain. This illustrates that dye stain is not normally a matter of concern for nontabular silver bromoiodide emulsions containing substantially optimum amounts of spectral sensitizing dye.

TABLE VI

Sensitometric and Dye Stain Effects of AgI Incorporation

| AgI Addition | | Green | | | | Dye Stain | | | |
|---|---|---|---|---|---|---|---|---|---|
| Layer | Ag, mg/m$^2$ | Speed | γ | Dmin | Dmax | Dmin | D 0.25 | D 0.5 | D 0.75 |
| Tabular Control | None | 100 | 2.81 | 0.01 | 3.9 | 0.11 | 0.09 | 0.07 | 0.08 |
| Emulsion | 54 | 62 | 2.87 | 0.01 | 3.7 | 0.13 | 0.08 | 0.01 | 0.00 |
| Emulsion | 27 | 71 | 3.08 | 0.01 | 3.7 | 0.12 | 0.09 | 0.02 | 0.00 |
| Emulsion | 11 | 76 | 3.10 | 0.01 | 3.7 | 0.12 | 0.09 | 0.03 | 0.02 |
| Overcoat | 54 | 100 | 2.66 | 0.01 | 3.7 | 0.05 | 0.05 | 0.02 | 0.00 |
| Overcoat | 27 | 100 | 2.72 | 0.03 | 3.9 | 0.10 | 0.07 | 0.01 | 0.00 |
| Nontabular Control | None | 95 | 3.08 | 0.10 | 4.1 | 0.03 | — | — | — |

The invention has been described in detail with particular reference to preferred embodiments thereof, but it will be understood that variations and modifications can be effected within the spirit and scope of the invention.

What is claimed is:

1. In a photographic element capable of producing a stable, viewable silver image on development in an aqueous alkaline processing solution and fixing out comprising a support and one or more image recording silver halide emulsion layers each comprised of a dispersing medium and latent image forming silver halide grains, said halide consisting essentially of chloride, bromide, or mixtures thereof, at least one of said image recording silver halide emulsion layers being comprised of spectral sensitizing dye adsorbed to the surface of tabular latent image forming silver halide grains having a thickness of less than 0.5 μm and an average aspect ratio of at least 5:1 accounting for at least 35 percent of the total projected area of said latent image forming silver halide grains present in said silver halide emulsion layer, the improvement comprising high iodide silver halide grains of less than 0.25 μm in mean diameter located in proximity to said tabular silver halide grains and limited to a concentration capable of being dissolved on fixing out.

2. A photographic element according to claim 1 in which the iodide present in said high iodide silver halide grains is less than 5 mole percent of the total halide present in said photographic element.

3. A photographic element according to claim 2 in which the iodide present in said high iodide silver halide grains is less than 3 mole percent of the total halide present in said photographic element.

4. A photographic element according to claim 1 in which said high iodide silver halide grains have a mean diameter of less than 0.1 μm.

5. A photographic element according to claim 1 in which said high iodide silver halide grains are present in said image recording silver halide emulsion layer containing said tabular latent image forming silver halide grains.

6. A photographic element according to claim 1 in which said high iodide silver halide grains are present in a hydrophilic colloid layer adjacent to said image recording silver halide emulsion layer containing said tabular latent image forming silver halide grains.

7. A photographic element according to claim 6 in which said hydrophilic colloid layer containing said high iodide silver halide grains overlies said image recording emulsion layer.

8. A photographic element according to claim 1 in which said spectral sensitizing dye is present in an amount sufficient to form a monolayer coverage of from 25 to 100 percent of the total available surface area of said tabular silver halide grains.

9. A photographic element according to claim 1 in which said high iodide silver halide grains are comprised of at least 90 mole percent iodide, based on total halide.

10. A photographic element according to claim 9 in which the halide content of said high iodide silver halide grains consists essentially of iodide.

11. A photographic element according to claim 1 in which said tabular grain containing image recording silver halide emulsion layer is a high aspect ratio tabular grain emulsion layer wherein the silver halide grains having a thickness of less than 0.3 μm and a diameter of at least 0.6 μm have an average aspect ratio of greater than 8:1 and account for at least 50 percent of the total projected area of the silver halide grains present in said emulsion layer.

12. A photographic element according to claim 1 in which said tabular grain containing image recording emulsion layer is a thin, intermediate aspect ratio tabular grain emulsion layer wherein the tabular silver halide grains having a thickness of less than 0.2 μm and average aspect ratio of from 5:1 to 8:1 account for at least 50 percent of the total projected area of the silver halide grains present in said emulsion layer.

13. In a radiographic element capable of producing a stable, viewable silver image on development in an aqueous alkaline processing solution and fixing out comprised of first and second image recording silver halide emulsion layers each comprised of a dispersing medium and latent image forming silver bromide grains, a film support interposed between said emulsion layers capable of transmitting radiation to which said image recording emulsion layers are responsive, at least said first image recording silver halide emulsion layer being a high aspect ratio tabular grain emulsion layer wherein the latent image forming silver bromide grains having a thickness of less than 0.3 μm and a diameter of at least 0.6 μm have an average aspect ratio of greater than 8:1 and account for at least 50 percent of the total projected area of the latent image forming silver bromide grains present in said first emulsion layer, said high aspect ratio tabular emulsion layer containing spectral sensitizing dye in an amount sufficient to form a monolayer coverage of from 25 to 100 percent of the total available surface area of said tabular silver bromide grains, the improvement comprising high iodide silver halide grains of from 0.25 μm to 0.01 μm in mean diameter located in proximity to said tabular silver bromide grains of said first emulsion layer in a concentration of less than 3 mole percent, based on total halide present in said first emulsion layer.

14. A radiographic element according to claim 13 in which said high iodide silver halide grains consist essentially of silver iodide and have a mean diameter of less than 0.10 μm.

15. A radiographic element according to claim 14 in which said silver iodide grains are present in a hydrophilic colloid layer adjacent said first silver bromide emulsion layer.

16. A radiographic element according to claim 14 in which said first and second silver bromide emulsion layers are each high aspect ratio tabular grain emulsion layers and said high iodide silver halide grains are located in proximity to each of said high aspect ratio tabular emulsion layers.

* * * * *